US005115544A

United States Patent [19]

Widen

[11] Patent Number: 5,115,544

[45] Date of Patent: May 26, 1992

[54] NON-WOVENS MANUFACTURING PROCESS

[75] Inventor: Christian B. Widen, Gallatin, Tenn.

[73] Assignee: Albany International Corp., Albany, N.Y.

[21] Appl. No.: 503,740

[22] Filed: Apr. 3, 1990

[51] Int. Cl.[5] ..... D04H 1/46; D06C 23/00

[52] U.S. Cl. ..... 28/105

[58] Field of Search ..... 28/104, 105

[56] References Cited

U.S. PATENT DOCUMENTS

| | | | |
|---|---|---|---|
| 3,034,180 | 5/1962 | Greiner et al. | 28/104 X |
| 3,486,168 | 12/1969 | Evans et al. | 28/105 X |
| 3,679,536 | 7/1972 | Kalwaites | 28/105 X |
| 3,681,182 | 8/1972 | Kalwaites | 28/105 X |
| 3,750,237 | 8/1973 | Kalwaites | 28/105 |
| 3,769,659 | 11/1973 | Kalwaites | 28/104 |
| 3,917,785 | 11/1975 | Kalwaites | 28/104 X |
| 4,465,726 | 8/1984 | Holmes et al. | 28/105 X |
| 4,718,152 | 1/1988 | Suzuki et al. | 28/104 |

FOREIGN PATENT DOCUMENTS

| | | | |
|---|---|---|---|
| 700364 | 12/1964 | Canada | 28/105 |

*Primary Examiner*—Werner H. Schroeder
*Assistant Examiner*—John J. Calvert
*Attorney, Agent, or Firm*—Kane, Dalsimer, Sullivan, Kurucz, Levy, Eisele and Richard

[57] ABSTRACT

A method for producing a non-woven fabric having specific designed patterns in designated areas is shown. The method requires the use of a fine-mesh woven screen of metal or plastic threads. The desired patterns may be pressed onto the screen to form raised indentations. Alternatively, they may be attached or extruded thereon, or woven or stitched thereinto. The non-woven fabrics produced, using the screens in place of those typically found on a non-woven fabric production apparatus, will have patterns corresponding to those on the screen.

11 Claims, 4 Drawing Sheets

FIG. 3
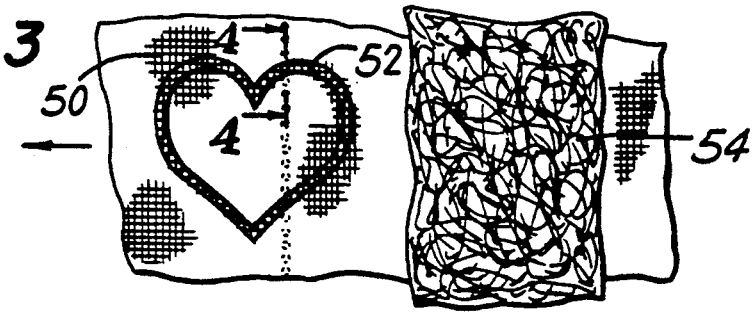
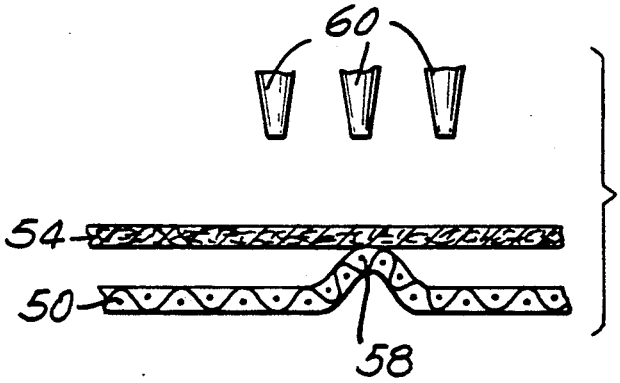
FIG. 4
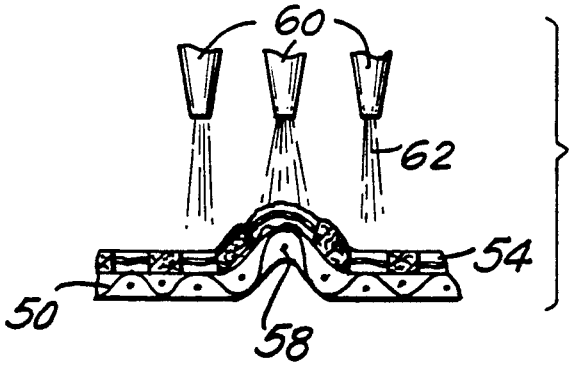
FIG. 5
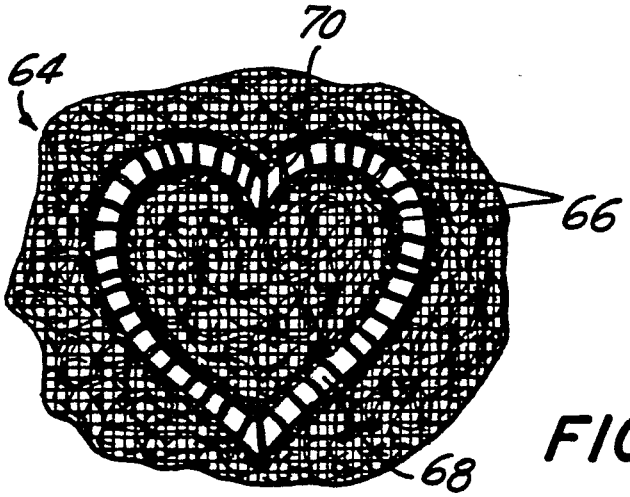
FIG. 6

FIG. 7
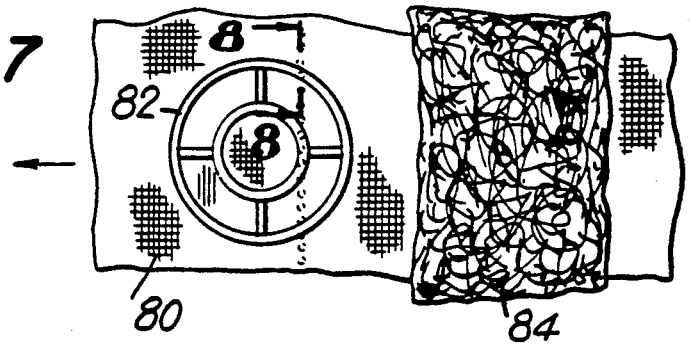
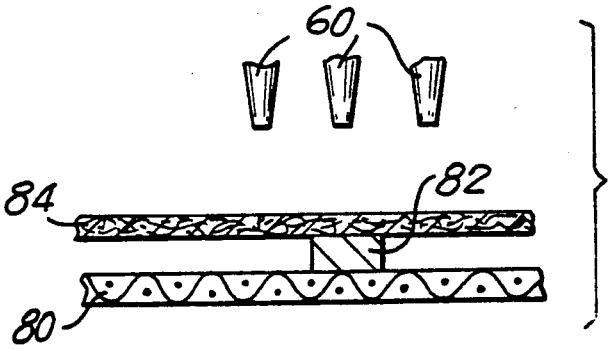
FIG. 8
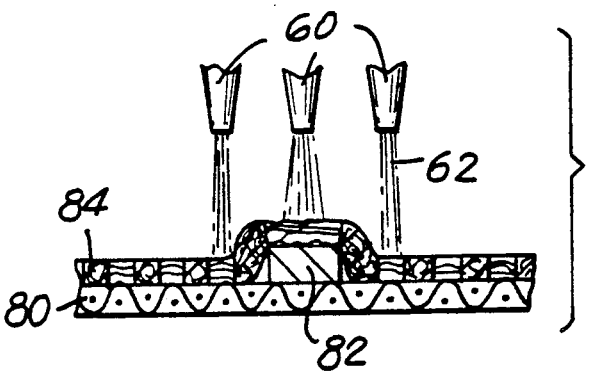
FIG. 9
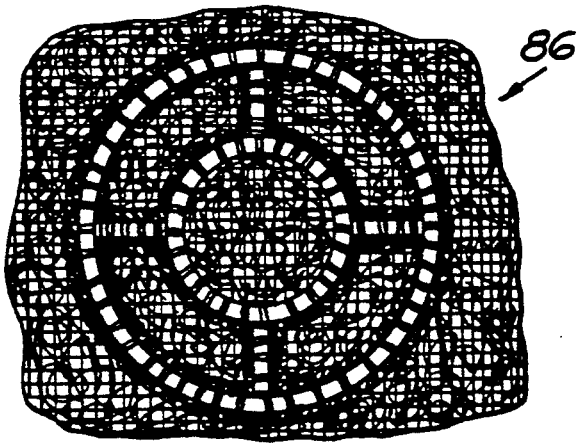
FIG. 10

FIG. 11
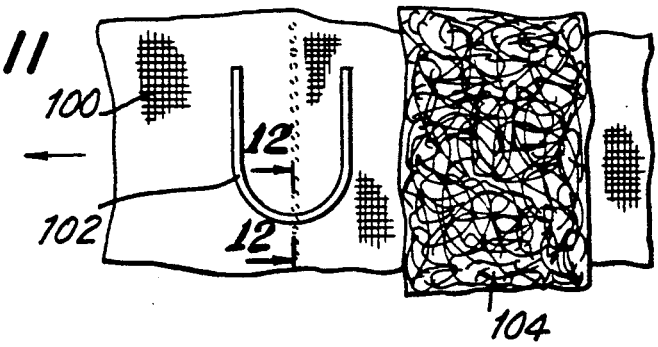
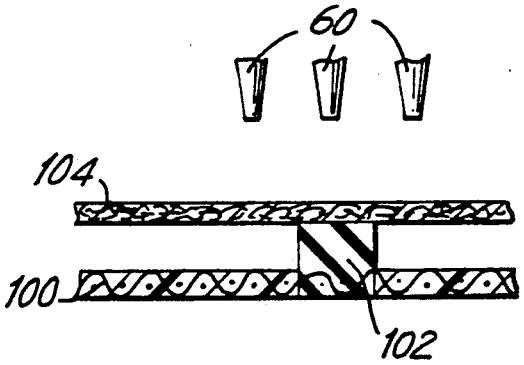
FIG. 12
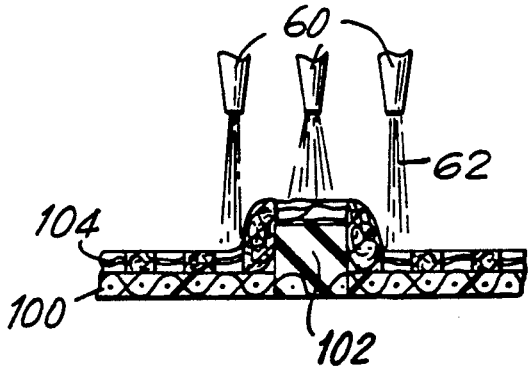
FIG. 13
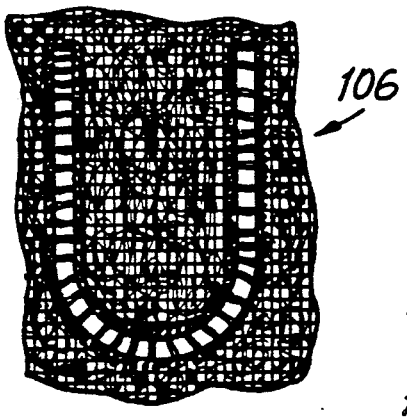
FIG. 14
FIG. 15
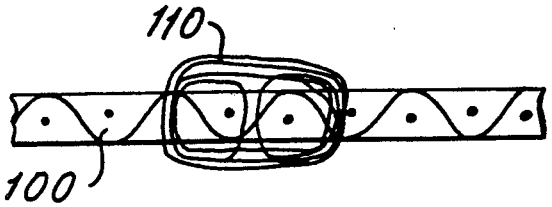

NON-WOVENS MANUFACTURING PROCESS

BACKGROUND OF THE INVENTION

1. Field of the Invention

The present invention relates to the production of non-woven spun-lace fabrics, and in particular to the production of such fabrics having a specific pattern or design only in designated areas thereof.

2. Description of the Prior Art

The production of non-woven textile fabrics is known in the art. Such a fabric is one produced directly from fibers without the use of conventional spinning, weaving, or knitting operations. A non-woven fabric can be made to resemble a woven fabric in appearance, when suitably manufactured.

Generally, such fabrics are manufactured by placing a fibrous web onto a woven screen. High-pressure water jets are then directed vertically down onto the web to entangle the fibers with each other. At the same time, the resulting entangled web acquires a surface pattern corresponding to that of the supporting screen surface. The finer the mesh of the supporting screen, the finer will be the surface pattern of the non-woven fabric. In this way, the product can closely resemble a woven fabric in appearance.

The surface pattern results from the knuckles of the woven screen used to support the fibrous web. Where the strands in one direction in the woven screen weave over those in the other, the knuckles so formed represent raised points on the surface of the screen. The high-pressure water jets will tend to wash the fibers from these points, while entangling those in other areas surrounding the knuckles. Consequently, the product non-woven fabric will have a regular pattern of holes corresponding to the raised knuckles on the woven screen.

SUMMARY OF THE INVENTION

The present invention provides a method for imparting a specific designed pattern only in designated areas of the non-woven fabric, rather than uniformly all over its surface. The method requires the use of a fairly fine-mesh base wire screen of either metal or plastic threads, so that the background areas of the non-woven fabric around the specific designs will be as uniform as possible. On the base wire screen, the specific designs are disposed in any of a number of different ways.

Where the base wire screen is woven from metal threads, the design may take the form of separate elements welded onto the surface of the screen. Alternatively, it may be directly impressed on the screen in the form of raised indentations.

Where the base wire screen is woven from plastic filaments, the design can take the form of additional plastic or rubber-like material extruded onto the surface of the screen. Alternatively, the design may be woven in or stitched on to the screen with other threads to form the desired pattern.

In any case, the fibrous web is deposited on the surface of the now-patterned wire screen. Under the influence of the high-pressure water jets, substantially open areas corresponding to the design on the base wire screen will be formed on the non-woven fabric which results.

The base wire screen with a design pattern, used with the method of the present invention, could take the form of either a drum cover or a travelling belt on equipment used in the production of non-woven fabrics.

The present invention will be more particularly described with the support of a number of illustrative drawings, which are identified below.

BRIEF DESCRIPTION OF THE DRAWINGS

FIGS. 3 through 6 show the sequence followed to produce a non-woven fabric according to a first embodiment of the present invention.

FIGS. 7 through 10 show the same sequence according to a second embodiment of the present invention.

FIGS. 11 through 14 show the same sequence according to a third embodiment of the present invention.

FIG. 15 shows a fine-mesh wire screen, having a specific designed pattern formed by threads embroidered thereinto, in an enlarged cross-sectional view.

DETAILED DESCRIPTION OF THE PREFERRED EMBODIMENT

The method of the present invention can be practiced with fine-mesh wire screens taking either a travelling belt or drum cover form, on equipment generally used to produce unpatterned non-woven fabrics.

Figure 1:
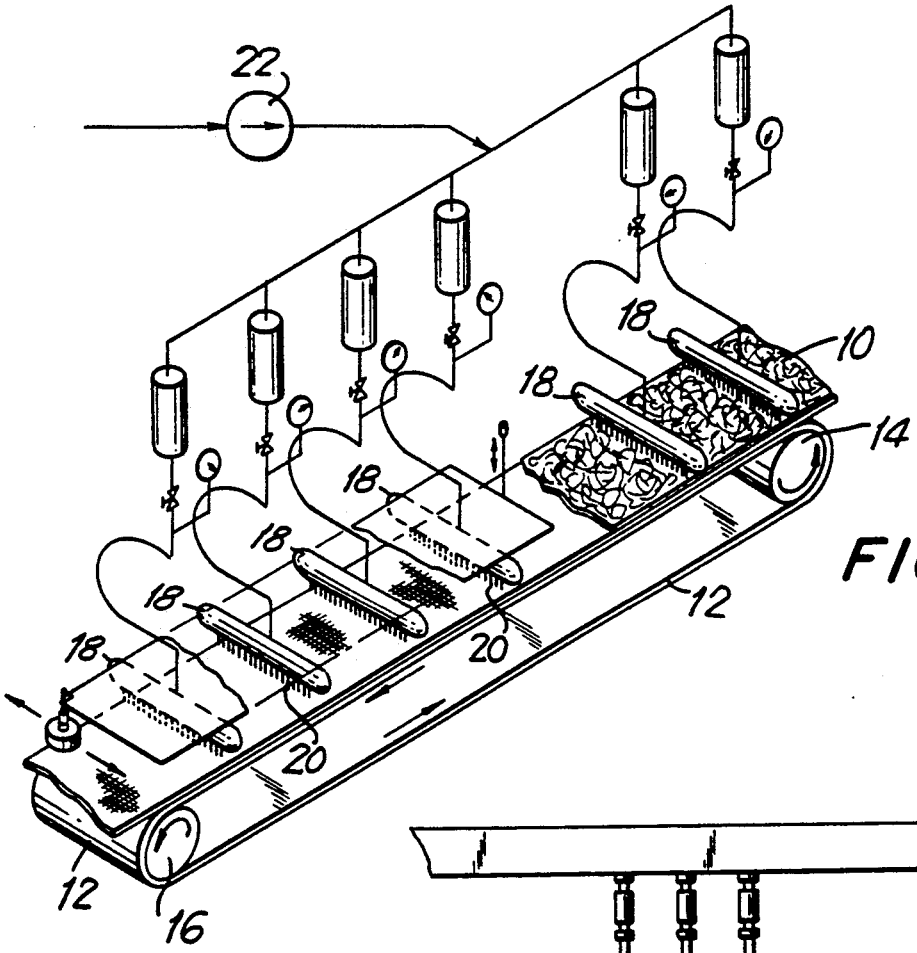
FIG. 1 is a schematic isometric view of an apparatus used in the production of a non-woven fabric and incorporating a fine-mesh wire screen in the form of a travelling belt.

By way of introduction to the practice of the present invention, FIG. 1 presents a schematic isometric view of an apparatus used in the production of a non-woven fabric and incorporating a fine-mesh wire screen in the form of a travelling belt. Specifically, a fibrous layer 10, which is a batt of non-woven staple fibers, is continuously deposited onto a fine-mesh wire screen 12, having the form of a travelling belt. The screen 12 is supported on two or more rolls 14, 16 driven to rotate in the directions indicated by the arrows by suitable driving means not shown. The screen 12 carries the fibrous layer 10 in a conveyor-like fashion. In FIG. 1, six banks of orifice manifolds 18 are supported above the belt to impinge liquid streams 20 on the fibrous layer 10 at successive positions during its travel on the wire screen 12. A pump 22 is used to provide liquid at the required pressure to the orifice manifolds 18. The wire screen 12, physically taking the form of a travelling belt on the apparatus shown in FIG. 1, has specific designed patterns in designated areas to impart the same upon the non-woven fabrics made in accordance with the present invention.

Figure 2:
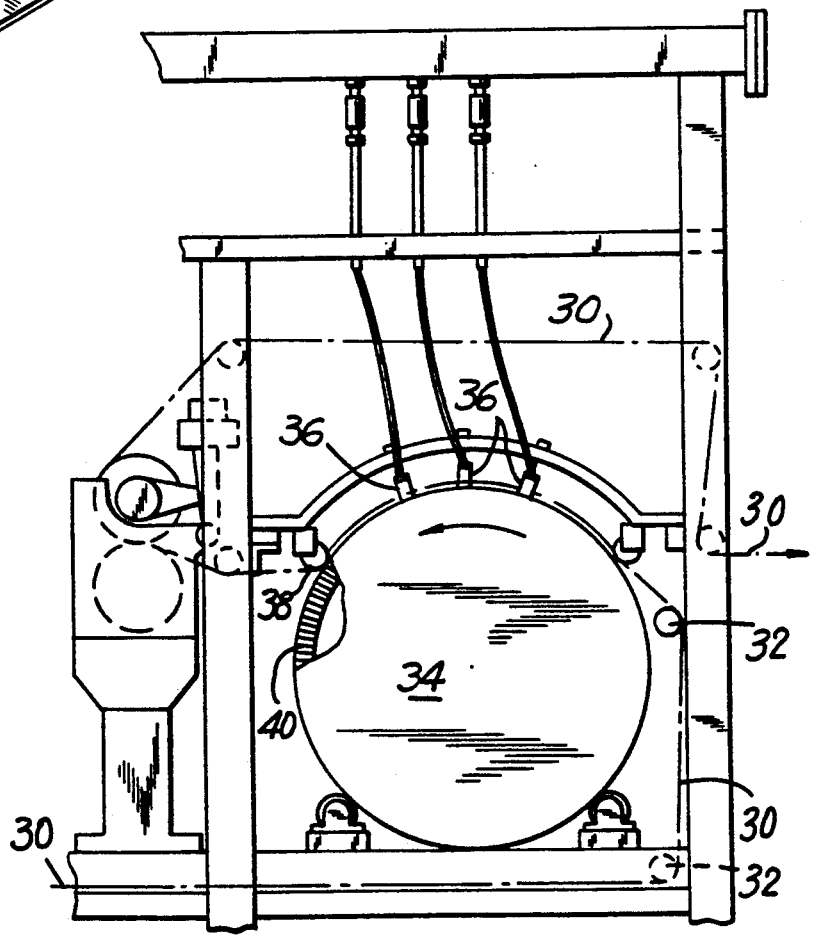
FIG. 2 is a side view of a treatment drum, part of a jet treatment apparatus for producing a non-woven fabric.

Turning to FIG. 2, a side view of a treatment drum, which is part of a jet treatment apparatus for producing a non-woven fabric, is shown there. The fibrous layer 30 is guided by rolls 32 onto the cylindrical surface of the treatment drum 34, is carried on the surface of the treatment drum 34 under water jet manifolds 36, and leaves the treatment drum 34 at guide roll 38.

The treatment drum 34 is constructed so that the cylindrical surface thereof supporting the fibrous layer 30 is a fine-mesh wire screen required for the practice of the present invention. Such a screen not having sufficient rigidity must be supported. A honeycomb support 40 made of thin sheet metal gives acceptable results. In this apparatus, then, a fine-mesh wire screen, supported by honeycomb support 40, takes the form of a drum cover on the cylindrical surface of the treatment drum 34.

In the present invention, the fine-mesh wire screen having the specific designed pattern in designated areas can itself take several different forms.

One such form is illustrated in accompanying FIG. 3. There, the fine-mesh wire screen 50 is woven from metal wire in a mesh substantially finer than that typically used in window screening. Impressed thereon is a specific designed pattern 52 which, for the sole purpose of providing an illustration, has a heart shape. In general, the pattern is pressed into the screen from the side opposite to that upon which the fibrous web is placed. In this way, the raised indentations so produced on the screen will leave the desired and corresponding pattern on the non-woven fabric. FIG. 3 also shows a fibrous layer 54 adjacent to specific designed pattern 52 on the fine-mesh woven screen 50.

FIG. 4 includes a cross-sectional view of the fine-mesh wire screen 50 taken along line 4—4 in FIG. 3. Part of the specific designed pattern 52 appears in FIG. 4 as raised peak 58. A fibrous layer 54, also viewed in cross section, is shown disposed upon the raised peak 58 of the specific designed pattern 52. Above the fibrous layer 54 are three nozzles 60, through which a suitable liquid under high pressure sprays down upon the fine-mesh wire screen 50 and fibrous layer 54.

In FIG. 5, liquid 62 is shown spraying down upon the fine-mesh wire screen 50 and fibrous layer 54. The liquid 62 entangles the individual fibers making up the fibrous layer 54 with one another and ultimately produces the non-woven fabric. In the area of the raised peak 58, the liquid 62 tends to clear individual fibers of the fibrous layer 54 away therefrom, leaving behind comparatively fewer fibers than are found in surrounding areas. The result is shown in FIG. 6, where the non-woven fabric 64 of the present invention includes uniform areas 66, surrounding the specific designed pattern 68, having an appearance corresponding to the uniform areas of the screen 50. The finer the mesh of the screen 50, the finer will be the texture of the uniform areas of the non-woven fabric 64. As can be further seen, the specific designed pattern 68 corresponds to that on the screen 50. It should be noted that the specific designed pattern 68 on the non-woven fabric 64 has comparatively fewer fibers 70 than surrounding uniform areas 66 of the non-woven fabric 64. Those fibers 70 remaining there after fiber entanglement largely extend in directions transverse to that of the specific designed pattern 52 on the fine-mesh wire screen 50, and both define the specific designed pattern 68 on the non-woven fabric 64 and hold the uniform area 66 within the pattern 68 to that without.

In FIGS. 7 through 10, a second embodiment of the non-woven manufacturing process is illustrated. The important details are the same as those already set forth above and will not be repeated. The difference between this second embodiment and that previously described resides in the manner in which the specific designed pattern is applied to the fine-mesh wire screen.

With reference to FIG. 7, a fine-mesh wire screen 80 has a specific designed pattern 82, which includes two concentric circles. The specific designed pattern 82 is in this case formed from individual wire segments attached, such as, for example, by welding, to the surface of the fine-mesh wire screen 80.

FIG. 8 includes a cross-sectional view, taken along the line 8—8 in FIG. 7, of the fine-mesh wire screen 80 and specific designed pattern 82 attached thereto. A fibrous layer 84 is then deposited on top of the specific designed pattern 82, and the process proceeds as previously described above. FIG. 9 shows liquid 62 spraying toward fibrous layer 84 through nozzles 60. FIG. 10 shows a non-woven fabric 86 which is thereby produced.

A third embodiment of the non-woven manufacturing process is shown in FIGS. 11 through 14. Again, the details of the manufacturing process are identical to those provided above. The difference between this and previously described embodiments again resides in the manner in which the specific designed pattern is applied to the fine-mesh wire screen.

With reference to FIG. 11, a fine-mesh wire screen 100 has a specific designed pattern 102 in a U-shape. In this embodiment, the screen 100 is woven from synthetic monofilament, and may be of a duplex weave. The specific designed pattern 102 is produced by depositing a plastic or rubber-like resinous material upon the surface of the screen 100 in the desired configuration. This material will at least partially seep through the screen 100, thereby anchoring the pattern 102 to the screen 100.

FIG. 12 includes a cross-sectional view, taken along the line 12—12 in FIG. 11, of the fine-mesh wire screen 100 and specific designed pattern 102 attached thereto. A fibrous layer 104 is then deposited on top of the specific designed pattern 102, and the process proceeds as previously described above. As can be seen in FIG. 12, the resinous material of the specific designed pattern 102 surrounds some of the threads from which screen 100 is woven. This serves to anchor the specifically designed pattern 102 to the screen 100. The permeability of the pattern 102 is much less than that of the uniform areas of the fine-mesh wire screen surrounding it.

FIG. 13 shows liquid 62 spraying toward fibrous layer 104 through nozzles 60. FIG. 14 shows a non-woven fabric 106 which is thereby produced.

When a synthetic monofilament is used to weave the fine-mesh wire screen, the specific designed pattern may alternatively be stitched into the fine-mesh woven screen in an embroidered form, or woven in during the weaving of the screen. In another possible embodiment, the specific designed pattern may be formed by synthetic monofilament extruded directly onto the surface of the screen.

For the purpose of illustration, FIG. 15 is an enlarged cross-sectional view of a fine-mesh wire screen 100 having a specific designed pattern, like pattern 102 in FIG. 1, formed by stitching or embroidering with threads 110. If specific designed pattern 102 in FIG. 11 were formed in this manner, FIG. 15 would be a cross section of FIG. 11 taken along line 12—12 thereof.

The patterned non-woven fabrics made in accordance with the method of the present invention may be used as napkins, wipes, table cloths, curtains, and other decorative cloths.

Modifications to the above would be obvious to those skilled in the art without departing from the scope of the present invention as described in the appended claims.

What is claimed is:

1. A fine-mesh woven screen 1 for use in manufacturing a non-woven fabric 1 having a plurality of specific unconnected designed patterns, each of said plurality of patterns being surrounded by a uniform background area, said fine-mesh woven screen having a surface with said plurality of specific designed patterns in designated areas thereof, said substantially uniform areas thereby forming a continuous whole on said surface of said fine-mesh woven screen, so that said non-woven fabric manufactured thereon may be substantially uniform but may have a plurality of specific designed patterns in designated areas corresponding to said plurality of specific designed patterns in said designated areas on said surface of said fine-mesh woven screen.

2. A fine-mesh woven screen as claimed in claim 1 wherein said fine-mesh woven screen is woven from strands of metal wire.

3. A fine-mesh woven screen as claimed in claim 1 wherein one of said plurality of specific designed patterns in said designated areas of said fine-mesh woven screen is a raised indentation pressed thereinto.

4. A fine-mesh woven screen as claimed in claim 2 wherein one of said plurality of specific designed patterns in said designated areas of said fine-mesh woven screen is shaped from wire segments and attached to said surface of said fine-mesh woven screen.

5. A fine-mesh woven screen as claimed in claim 1 wherein said fine-mesh woven screen is woven from synthetic monofilament.

6. A fine-mesh woven screen as claimed in claim 5 wherein one of said plurality of specific designed patterns in said designated areas of said fine-mesh woven screen is formed of a synthetic monofilament extruded onto said surface of said fine-mesh woven screen in said specific designed pattern.

7. A fine-mesh woven screen as claimed in claim 5 wherein one of said plurality of specific designed patterns in said designated areas of said fine-mesh woven screen is stitched into said fine-mesh woven screen.

8. A fine-mesh woven screen as claimed in claim 5 wherein one of said plurality of specific designed patterns in said designated areas of said fine-mesh woven screen is woven in during the weaving of said fine-mesh woven screen.

9. A fine-mesh woven screen as claimed in claim 5 wherein one of said plurality of specific designed patterns in said designated areas of said fine-mesh woven screen is formed with a synthetic polymer material applied to said surface of said fine-mesh woven screen in said specific designed pattern.

10. A fine-mesh woven screen as claimed in claim 1 wherein said fine-mesh woven screen is the cover on a cylindrical, rotating drum.

11. A fine-mesh woven screen as claimed in claim 1 wherein said fine-mesh woven screen is a travelling belt.

* * * * *